US009850095B2

(12) United States Patent
Moon

(10) Patent No.: US 9,850,095 B2
(45) Date of Patent: Dec. 26, 2017

(54) ELEVATOR GENERATING ELECTRIC ENERGY USING DISPLACEMENT THEREOF

(71) Applicant: Hyeon Cheol Moon, Muan (KR)

(72) Inventor: Hyeon Cheol Moon, Muan (KR)

(73) Assignee: Hyeon Cheol Moon, Muan-gun (KR)

( * ) Notice: Subject to any disclaimer, the term of this patent is extended or adjusted under 35 U.S.C. 154(b) by 432 days.

(21) Appl. No.: 14/411,596

(22) PCT Filed: Jul. 5, 2013

(86) PCT No.: PCT/KR2013/006019
§ 371 (c)(1),
(2) Date: Dec. 29, 2014

(87) PCT Pub. No.: WO2014/007587
PCT Pub. Date: Jan. 9, 2014

(65) Prior Publication Data

US 2015/0191329 A1 Jul. 9, 2015

(30) Foreign Application Priority Data

Jul. 5, 2012 (KR) ..... 10-2012-0073494

(51) Int. Cl.
*B66B 1/06* (2006.01)
*B66B 7/00* (2006.01)
(Continued)

(52) U.S. Cl.
CPC ..... *B66B 7/00* (2013.01); *B66B 1/302* (2013.01); *B66B 9/00* (2013.01); *B66B 11/0407* (2013.01)

(58) Field of Classification Search
CPC .. B66B 7/00; B66B 1/302; B66B 9/00; B66B 11/0407
(Continued)

(56) References Cited

U.S. PATENT DOCUMENTS 4,570,753 A * 2/1986 Ohta ..... B66B 11/0407 187/251
5,062,501 A * 11/1991 Pavoz ..... B66B 11/0407 187/289
(Continued)

FOREIGN PATENT DOCUMENTS

CN 205442304 U * 8/2016
JP 1997-202571 8/1997
(Continued)

*Primary Examiner* — Anthony Salata
(74) *Attorney, Agent, or Firm* — Lex IP Meister, PLLC

(57) ABSTRACT

Provided is an electricity generating elevator, which includes a cage installed in a shaft formed in a building in order to carry passengers or loads, a drive unit vertically moving the cage along the shaft, and an electricity generation unit including a coil section installed on the cage and a magnetic force generator that is installed in the shaft so as to face the coil section and provides a magnetic force to the coil section so as to generate an induced electromotive force according to a change in a position of the coil section while the cage moves up and down. Thereby, the electricity generating elevator includes the coil section attached to the cage and the magnetic force generator arranged in the shaft at a position facing the coil section, so that electric energy can be produced by the coil section according to a change in a position of the cage while the cage vertically reciprocates in the shaft, and the produced electric energy can be used as a power source for vertically moving the cage. Thus, maintenance expenses of the elevator can be reduced.

2 Claims, 5 Drawing Sheets

(51) Int. Cl.
*B66B 9/00* (2006.01)
*B66B 1/30* (2006.01)
*B66B 11/04* (2006.01)

(58) Field of Classification Search
USPC .... 187/247, 289, 290, 391, 393; 290/1 R, 7, 290/8, 14, 45; 198/619; 318/375, 376; 104/290; 310/12.01, 12.04, 12.09, 12.11, 310/12.12, 12.15
See application file for complete search history.

(56) References Cited

U.S. PATENT DOCUMENTS 5,288,956 A * 2/1994 Kadokura ..... B66B 11/0407 187/250
5,341,280 A * 8/1994 Divan ..... H01F 38/14 320/109
5,542,501 A * 8/1996 Ikejima ..... B66B 1/30 187/289
5,625,174 A * 4/1997 Ito ..... B66B 11/0055 187/250
5,751,076 A * 5/1998 Zhou ..... B66B 11/0407 187/250
5,816,368 A * 10/1998 Barrett ..... B66B 7/022 187/249
6,305,501 B1 * 10/2001 Kahkipuro ..... B66B 11/0407 187/250
8,089,167 B2 * 1/2012 Alvite ..... F03B 17/04 290/1 C
8,901,758 B1 * 12/2014 Nix ..... F03G 3/00 290/1 A
2003/0000778 A1 * 1/2003 Smith ..... B66B 1/30 187/289

FOREIGN PATENT DOCUMENTS

JP 2008-133122 6/2008
JP 2009-280353 12/2009

* cited by examiner

ELEVATOR GENERATING ELECTRIC ENERGY USING DISPLACEMENT THEREOF

TECHNICAL FIELD

The present invention relates to an electricity generating elevator and, more particularly, to an electricity generating elevator capable of producing electric energy using displacement of a cage for carrying passengers or loads while the elevator is operated.

BACKGROUND ART

With the recent Manhattanization of buildings, various elevators capable of rapidly and efficiently carrying a lot of passengers are developed and installed. As well known, the elevator is a transporting means for safely carrying passengers or loads while vertically linearly moving along a shaft (called an enclosed space) that is vertical formed in a building.

Conventional elevators generally include guide rails that is firmly vertically installed in a shaft in a building, a cage that moves up and down along the guide rails, a wire rope that is connected to the cage at one end thereof, a counterweight that is connected to the other end of the wire rope and moves along the guide rails installed vertically at one side of the shaft without overlapping a movement path of the cage in the opposite direction of the moving direction of the cage, and a driving motor that is installed at the uppermost portion of the shaft, is in frictional contact with the wire rope, and raises/lowers the cage and the counterweight by means of forward/backward rotation.

In the case of the conventional elevator systems, only a single driving motor is used, and thus the driving motor has a large size. To operate the large driving motor, a machine room in which the driving motor and related components are installed on the rooftop of the building should be provided, and thus there is a problem in that the space is inefficiently used. Further, a driving motor having high torque and output is used, which increases manufacturing and maintenance costs.

To solve these problems, an elevator system is disclosed in Korean Unexamined Patent Application Publication No. 10-2010-0110555.

Such an elevator system includes a plurality of driving motors, a cage that is raised/lowered by the driving motors, a counterweight that is operated opposite to the raising/lowering operation of the cage, a wire rope that is connected to the driving motors, the cage, and the counterweight at the same time, a sensing unit that measures weight of passengers and loads mounted in the cage, and a controller that controls the plurality of driving motors so as to be selectively operated.

However, this elevator system is operated by the plurality of driving motors, and thus requires much power for driving the plurality of driving motors.

DISCLOSURE

Technical Problem

The present invention is intended to resolve such problems, and is directed to providing an electricity generating elevator capable of producing electric energy using a change in a position of a cage according to upward/downward movement of the cage while the elevator is operated, and of storing or using the produced electric energy for a driving motor that raises/lowers the cage.

Technical Solution

To accomplish the above object, an electricity generating elevator according to the present invention includes a cage installed in a shaft formed in a building in order to carry passengers or loads, a drive unit vertically moving the cage along the shaft, and an electricity generation unit including a coil section installed on the cage and a magnetic force generator that is installed in the shaft so as to face the coil section and provides a magnetic force to the coil section so as to generate an induced electromotive force according to a change in a position of the coil section while the cage moves up and down.

Here, the drive unit may include main guide rails that are vertically installed in the shaft so as to guide a movement path of the cage and support the cage so as to be vertically movable along the shaft, a wire rope whose one end is connected to the cage, a counterweight that is connected to the other end of the wire rope so as to move in the opposite direction of a moving direction of the cage, sub-guide rails that are vertically installed in the shaft in parallel to the main guide rails at a given interval and support the counterweight so as to be vertically movable along the shaft, and a winding machine that winds up and off the wire rope so as to vertically move the cage. The winding machine may include a wheel that is supported on a rotary axle rotatably installed on a frame above the cage and the counterweight and causes rolling friction against the wire rope, and a driving motor that drives the wheel.

Advantageous Effects

The electricity generating elevator according to the present invention includes the electricity generation unit having the coil section attached to the cage and the magnetic force generator arranged in the shaft at a position facing the coil section, so that electric energy can be produced by the coil section according to a change in a position of the cage while the cage vertically reciprocates in the shaft, and the produced electric energy can be used as a power source for vertically moving the cage. Thus, maintenance expenses of the elevator can be reduced.

Further, the electricity generating elevator according to the present invention has the electricity generation unit installed on the case and in the shaft as well as on the counterweight and in the shaft, and thus can increase electricity generation efficiency.

MODES OF THE INVENTION

Hereinafter, electricity generating elevators according to exemplary embodiments of the present invention will be described in detail with reference to the accompanying drawings. The electricity generating elevator according to the present invention is illustrated in FIGS. 1 and 2.

Figure 1:
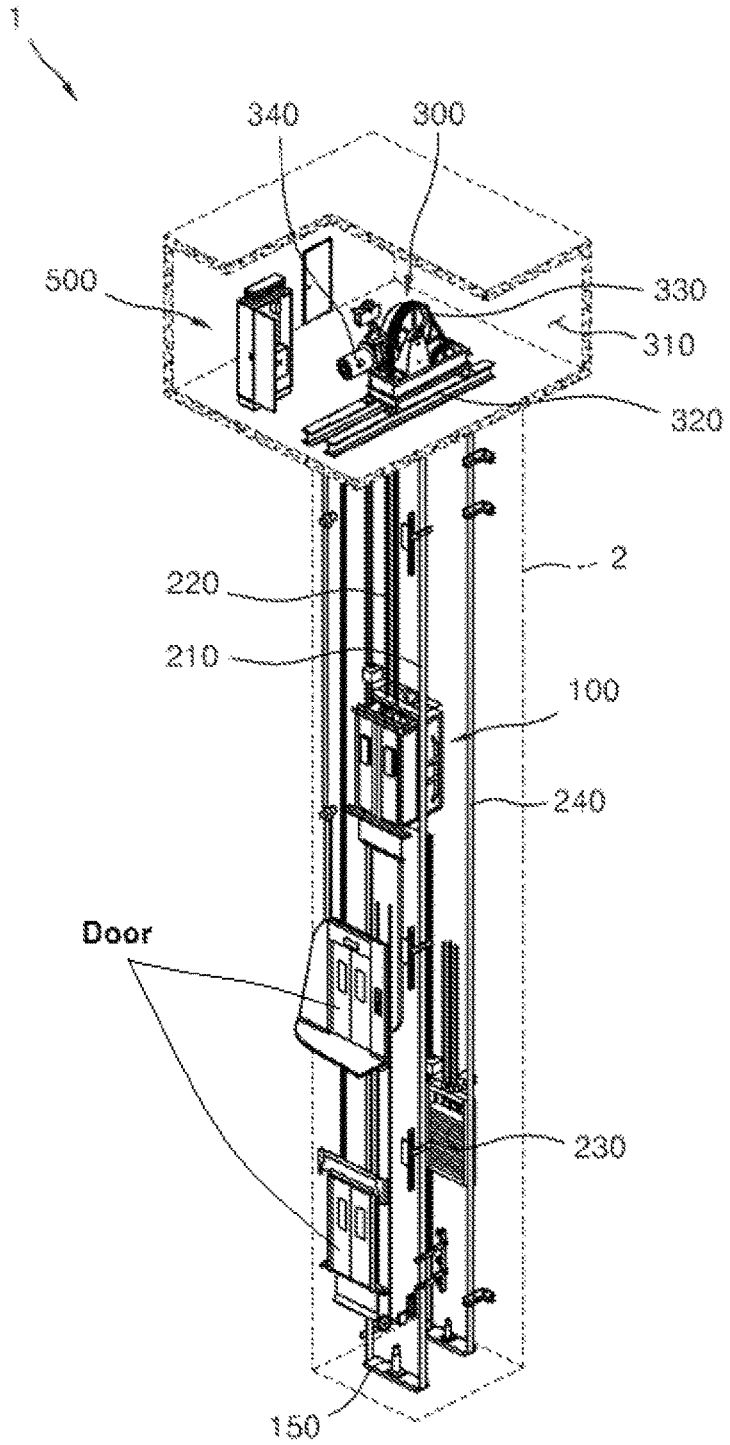
FIG. 1 is a perspective view of an electricity generating elevator according to a first embodiment of the present invention.
Figure 2:
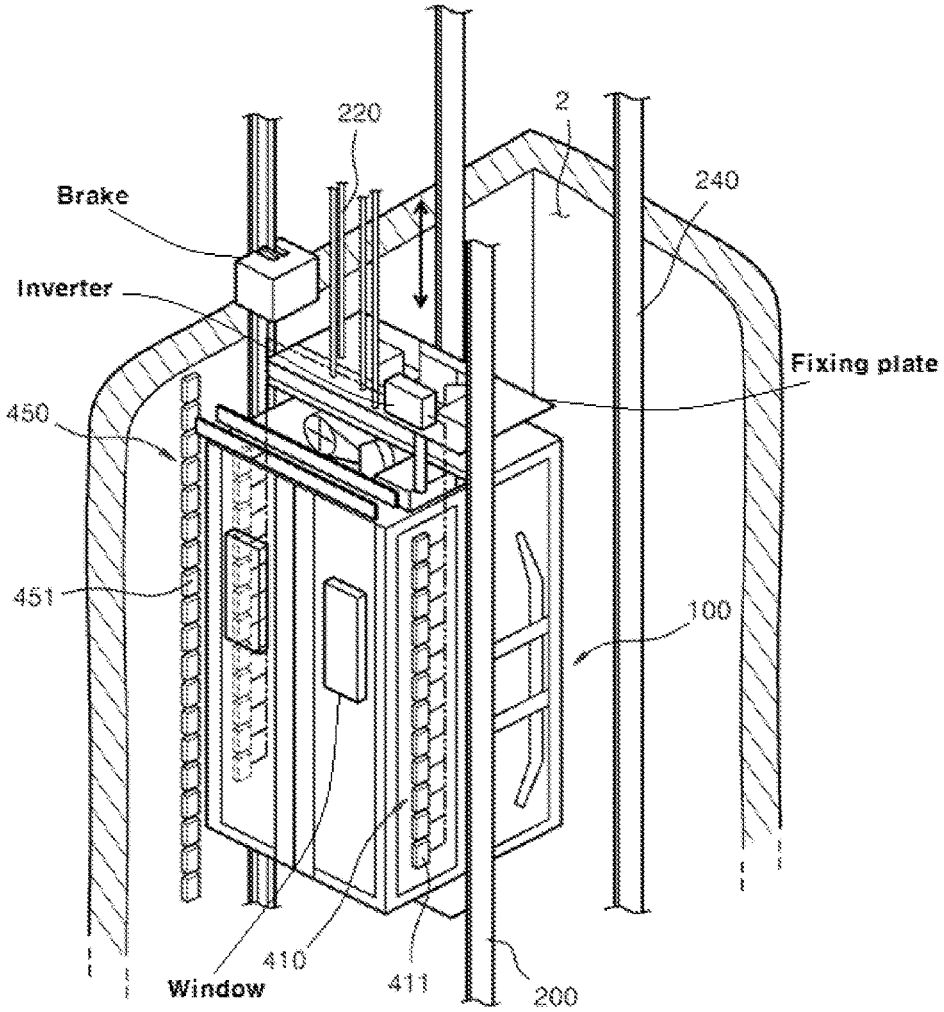
FIG. 2 is a detailed perspective view illustrating main components of the electricity generating elevator illustrated in FIG. 1.

Referring to FIGS. 1 and 2, the electricity generating elevator of the present invention includes a cage 100, a drive unit, an electricity generation unit, and a control unit 500.

The cage 100 is provided therein with a boarding space for carrying passengers or loads, and closable elevator doors that allow the passengers or the loads to enter the boarding space through a doorway. The cage 100 is installed in a shaft 2 formed vertically in a building so as to be movable up and down.

The cage 100 has the same structure as a typical elevator cage. A buffer 150 for cushioning any impact of the cage 100 when the cage 100 falls due to a failure is installed at the bottom of the shaft 2.

The drive unit is provided to vertically move the cage 100 along the shaft 2, and includes main guide rails 210 that are vertically installed in the shaft 2 so as to guide a movement path of the cage 100 and support the cage 100 so as to be vertically movable along the shaft 2, a wire rope 220 whose one end is connected to the cage 100, a counterweight 230 that is connected to the other end of the wire rope 220 so as to move in the opposite direction of a moving direction of the cage 100, sub-guide rails 240 that are vertically installed in the shaft 2 in parallel to the main guide rails 210 at a given interval so as to guide a movement path of the counterweight 230 and support the counterweight 230 so as to be vertically movable along the shaft 2, and a winding machine 300 that winds up and off the wire rope 220 so as to vertically move the cage 100.

The main guide rails 210, the sub-guide rails 240, the wire rope 220, and the counterweight 230 are typically used in an elevator system, and thus detailed description thereof will be omitted.

The winding machine 300 is installed in a machine room 310 that is provided separately from the shaft 2 at an upper portion of the shaft 2, i.e. at an upper portion of the building. The winding machine 300 includes a frame 320 installed in the machine room 310, a rotary axle that is rotatably installed on the frame 320, a wheel 330 that is supported on the rotary axle, is located above the main guide and sub-guide rails 210 and 240, and causes rolling friction against the wire rope 220 for raising/lowering the cage 100, a driving motor 340 that drives the wheel 330, and a brake unit (not shown) that is installed on a driving axle of the wheel 330 or a driving axle of the driving motor 340.

The electricity generation unit generates electricity using electromagnetic induction, and includes a coil section 410 that is fixed to the cage 100, and a magnetic force generator 450 that is installed in the shaft 2 and provides a magnetic force to the coil section 410 so as to generate an induced electromotive force according to a change in a position of the coil section 410 while the cage 100 moves up and down.

The coil section 410 is formed by winding a conducting wire having electric conductivity such that magnetic flux generated from the magnetic force generator 450 can pass.

The coil section 410 includes numerous unit coils 411, and the unit coils 411 are installed on an outer circumferential surface of the cage 100 at intervals. The unit coils 411 are mutually connected in series or parallel. Electric energy induced from each unit coil 411 is stored in a storage battery of the control unit 500 to be described below.

The magnetic force generator 450 is installed on an inner wall of the shaft 2, is disposed at a position facing the coil section 410 installed on the cage 100, and is arranged in line in a direction in which the shaft 2 extends, i.e. in a vertical direction. The magnetic force generator 450 employs permanent magnets 451.

A process of generating the induced electromotive force using the coil section 410 and the magnetic force generator 450 will be described. First, when the cage 100 moves upward or downward in a state in which it is stopped at an arbitrary position, the coil section 410 also moves along with the cage 100. Here, the magnetic force generator 450 disposed on the opposite side of the coil section 410 continues to provide a magnetic force toward the coil section 410.

With the movement of the cage 100, the magnetic flux passing through the unit coils 411 is repetitively increased and reduced. In this process, an induced current is generated from each unit coil 411 by the electromagnetic induction.

The aforementioned electromagnetic induction means that, when magnetic flux passing through a closed circuit is changed over time, an electromotive force proportional to a rate of change is generated in the closed circuit in a direction in which it obstructs a change in the magnetic flux. In other words, the present invention is realized by applying the unit coils 411 to a closed circuit and moving the unit coils 411 relative to the magnetic force generator 450 in order to change the magnetic flux.

In the present embodiment, the coil section 410 is installed on the cage 100, and the magnetic force generator 450 is installed on the inner wall of the shaft 2.

However, the opposite example may be applied. That is, any structure may be applied if relative movement between the coil section 410 and the magnetic force generator 450 is possible.

Unlike the illustrated example, the magnetic force generator 450 may be installed on the main guide rails 210 including or excluding the inner wall of the shaft 2. In this case, a separate bracket for installing the magnetic force generator 450 so as to be supported on the main guide rails 210 and to face the coil section 410 is preferably provided.

Figure 3:
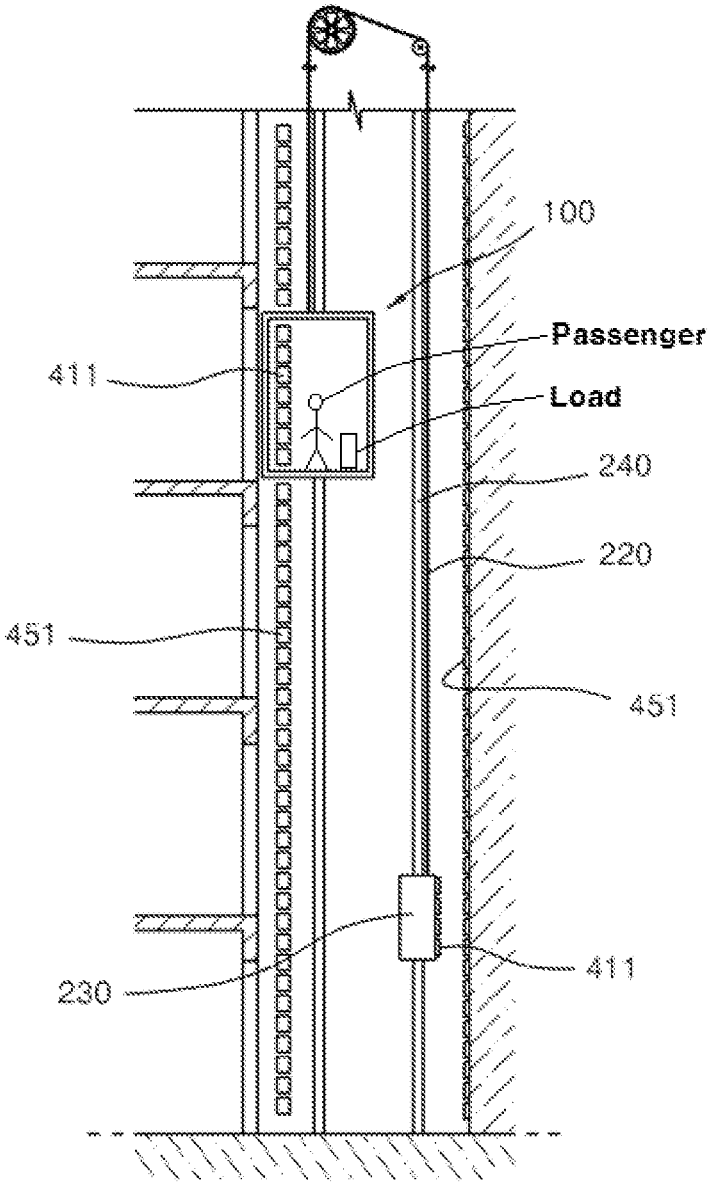
FIG. 3 is a schematic side view illustrating an electricity generating elevator according to a second embodiment of the present invention.

In addition, as illustrated in FIG. 3, the coils 411 of the coil section 410 may also be installed on the counterweight 230 in addition to the cage 100. In this case, the permanent magnets 451 providing the magnetic force to the coils 411 installed on the counterweight 230 are installed on the shaft 2 or the sub-guide rails 240 located opposite to the coils 411 installed on the counterweight 230. In this structure, electricity can be generated by the coils and the permanent magnets, both of which are respectively installed on the cage and the shaft or on the cage and the main guide rails. Further, secondary power can be produced by the coils 411 and the permanent magnets 451, both of which are respectively installed on the counterweight 230 moving in the opposite direction of the cage 100 and on the sub-guide rails 240 supporting the counterweight 230.

Figure 4:
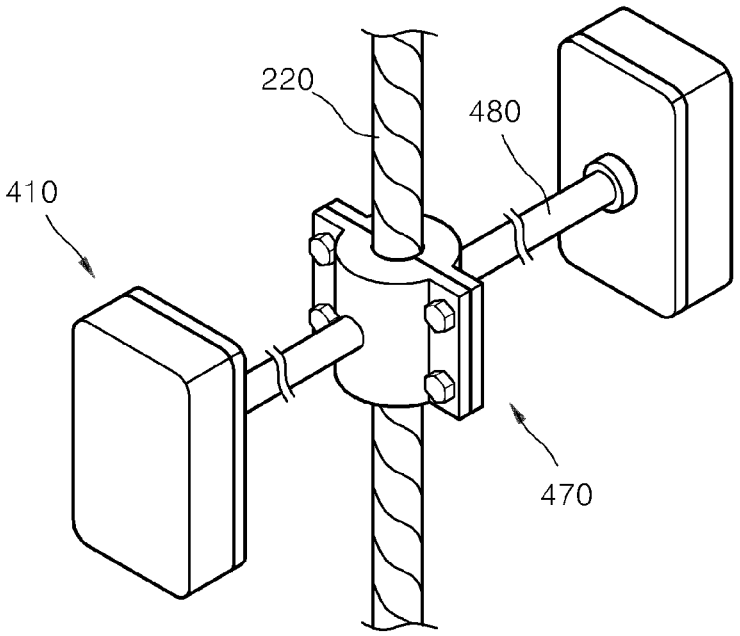
FIG. 4 is a detailed perspective view of an electricity generating elevator according to a third embodiment of the present invention.

Meanwhile, in the electricity generating elevator according to the present invention, as illustrated in FIG. 4, the coil sections 410 may be coupled to the wire rope 220 connected to the top of the cage 100 so as to be able to increase electricity generation output. A separate bracket 470 may be installed on the wire rope 220 so as to be adjacent to the magnetic force generator 450 installed in the shaft 2, and the coil sections 410 coupled to the wire rope 220 may be fixed to ends of support bars 480 extending from the bracket 470 at a given length.

The control unit 500 is installed inside the machine room 310, and controls an operation of the drive unit, particularly the winding machine 300. The control unit 500 includes a drive controller that controls an operation of the driving motor 340 for moving the cage 100 and controls an opening/closing operation of the doors of the cage 100, and an auxiliary power supply controller that stores the electric energy produced by the electricity generation unit and supplies the electric energy to the driving motor 340.

The auxiliary power supply controller is configured to collect the induced electromotive force generated from each coil section 410, store the induced electromotive force in the storage battery (not shown) as the electric energy, and supply the stored electric energy to the driving motor 340 as needed.

The control unit 500 may further include an inverter, and is configured to convert the electric energy produced by the electricity generation unit into a direct current through the inverter and store the direct current in the storage battery. The electric energy stored in the storage battery may be used as the power for raising/lowering the elevator as described above, or be supplied to electric fittings having relatively low power consumption such as lighting lamps installed in the building in which the elevator is installed.

Figure 5:
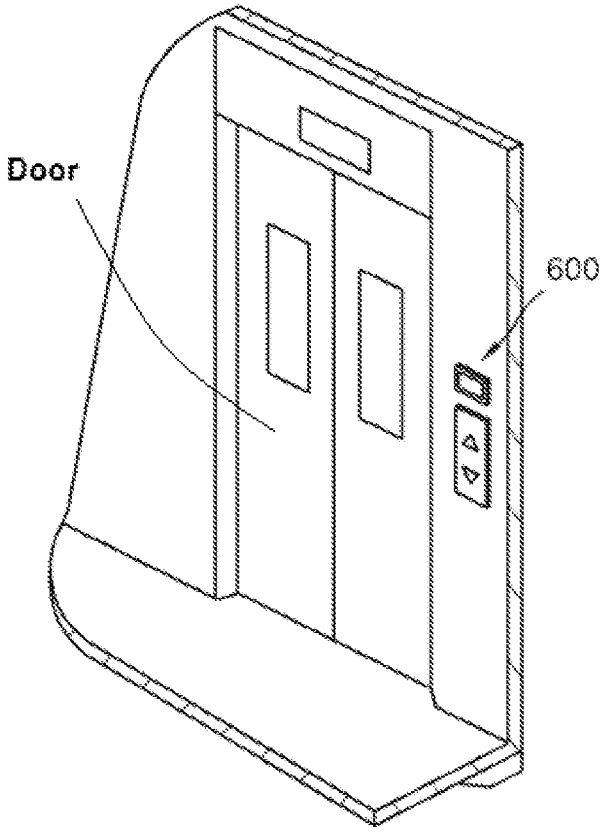
FIG. 5 is a detailed perspective view of an electricity generating elevator according to a fourth embodiment of the present invention.

Further, as illustrated in FIG. 5, the electricity generating elevator according to the present invention may further include a display unit 600 capable of displaying an amount of electricity that is currently generated by the electricity generation unit. The display unit 600 is installed in the cage and around a boarding standby platform of the elevator so as to enable the passengers getting in the cage as well as waiting passengers to recognize the electricity generation output.

Although the electricity generating elevator according to the present invention has been described with reference to the examples illustrated in the drawings, it will be understood to those skilled in the art that a variety of equivalents and modifications can be made at the time of filing the present invention.

Therefore, the genuine technical scope of the present invention should be defined from the accompanying claims.

The invention claimed is:

1. An elevator comprising:

a cage installed in a shaft formed in a building in order to carry a passenger or a load;

a counterweight installed in the shaft and connected to the cage through a wire rope so as to move in the opposite direction of a moving direction of the cage;

sub-guide rails that are vertically installed in the shaft and supports the counterweight so as to be vertically movable along the shaft;

a drive unit vertically moving the cage along the shaft;

a first electricity generation unit including a first coil section installed on the cage or the shaft and a first magnetic force generator that is installed on the shaft or the cage so as to face the first coil section and provides a magnetic force to the first coil section so as to generate an induced electromotive force according to relative position change between the first coil section and the first magnetic force generator while the cage moves up and down; and a second electricity generation unit including a second coil section installed on the counterweight and a second magnetic force generator installed on the shaft or the sub-guide rails to face the second coil section and provide a magnetic force to the second coil section so as to generate an induced electromotive force according to relative position change between the second coil section and the second magnetic force generator while the counterweight moves up and down.

2. The elevator of claim 1, wherein:

the drive unit includes main guide rails that are vertically installed in the shaft in parallel to the sub-guide rails at a given interval so as to guide a movement path of the cage and support the cage so as to be vertically movable along the shaft, and a winding machine that winds up and off the wire rope so as to vertically move the cage and the counterweight; and the winding machine includes a wheel that is supported on a rotary axle rotatably installed on a frame above the cage and the counterweight and causes rolling friction against the wire rope, and a driving motor that drives the wheel.

* * * * *